US006367779B1

(12) United States Patent
Martin et al.

(10) Patent No.: US 6,367,779 B1
(45) Date of Patent: Apr. 9, 2002

(54) POST PULLING MECHANISM

(76) Inventors: Robert B. Martin, P.O. Box 232, Kewanee, IL (US) 61443; David I. Tibbs, 3140 NW. 82nd Ave., Ankeny, IA (US) 50021

( * ) Notice: Subject to any disclaimer, the term of this patent is extended or adjusted under 35 U.S.C. 154(b) by 0 days.

(21) Appl. No.: 09/498,381

(22) Filed: Feb. 3, 2000

(51) Int. Cl.[7] ..... B25B 33/00
(52) U.S. Cl. ..... 254/243; 254/250; 294/92
(58) Field of Search ..... 294/92, 91; 254/243, 254/250

(56) References Cited

U.S. PATENT DOCUMENTS 215,720 A * 5/1879 Chapman
230,569 A * 7/1880 Porter et al.
387,735 A * 8/1888 Redford
654,001 A * 7/1900 Hull
1,476,877 A * 12/1923 Curtis
1,666,454 A * 4/1928 Johnson
1,778,682 A * 10/1930 McManus
2,226,456 A * 12/1940 Westendorf
2,777,726 A * 1/1957 Lundgren et al.
3,048,368 A * 8/1962 Linabery, Sr.
3,254,876 A * 6/1966 Powell
3,762,687 A * 10/1973 De Rome
4,250,769 A * 2/1981 Herring
5,141,276 A * 8/1992 McClure
5,713,557 A * 2/1998 Kang

* cited by examiner

*Primary Examiner*—Katherine A. Matecki
(74) *Attorney, Agent, or Firm*—Rockey, Milnamow & Katz, Ltd.

(57) ABSTRACT

A manual post puller mechanism having a lever extendable for increasing the amount of leverage applied for pulling the post from the ground, the lever being securable within a base and serving as a handle graspable by the operator for carrying the mechanism between locations. A chain extends downwardly from a chain engaging front portion of the lever which includes slots that allow the position of the chain to be adjusted so as to vary the amount of leverage applied to the post. A post holder mechanism carried at the bottom of the chain engages the post and defines an enclosed generally rectangular opening that receives the post. A pair of pivot plates coupled with the lever generally hinder an operator's fingers from being pinched during post pulling operations.

8 Claims, 4 Drawing Sheets

POST PULLING MECHANISM

BACKGROUND OF THE INVENTION

This invention relates to a mechanism for manually pulling posts from the ground.

Prior art post pullers typically include a stand that rests on and extends upwardly from the ground, and an arm that is pivotally connected to the stand. A rearward end of the arm can be grasped by the operator for pressing down on that end of the arm. This causes the front end of the arm on the opposite side of the pivotal connection with the stand to pivot upwardly. The front end of the arm is connected by some structure to the post to be pulled from the ground. As the operator presses down on the rear end of the arm, the front end of the arm pivots upwardly, thereby pulling the post out of the ground once sufficient force is applied.

One shortcoming of typical prior art post pulling devices is the structure that engages the post. Some prior art post pullers include a post engaging mechanism having a square opening that must be passed over the top of the post. This can be difficult with tall posts or if obstructions such as screws, or nails are fixed to the post or if the post has been knocked down and/or twisted. Other conventional devices provide a C-shaped bracket for engaging the post. These brackets include an opening in their side through which the post may pass, and therefore these brackets can be slipped around the side of a post. Because of the opening in the side of these brackets, some of these C-shaped brackets are relatively weak and are subject to failure by bending under the relatively large forces that develop during post pulling operations. Many prior art post engaging devices are also prone to slipping on the post. Many prior art post engaging devices have the disadvantage of being generally suited for only one type of post. Some devices are best suited for engaging square wooden posts, others for engaging metallic channel-type posts. Prior art post engaging devices are typically not adapted for adequately engaging various types and shapes of posts to hold the posts sufficiently as upward force is applied to the post during post pulling operations. Some prior art post engaging devices clamp down against the post with greater and greater force as the arm is pressed down with greater and greater force. These devices may cause damage to wooden and metal posts, and may be relatively difficult to get on and off the post.

Many prior art post pulling devices do not develop sufficient leverage or force for pulling a post from the ground in certain soil conditions. In the worst soil conditions where it is very difficult to pull a post from the ground, these prior art post pullers do not develop enough leverage or force to dislodge the post from the ground.

Furthermore, many prior art post pulling devices do not allow the amount of leverage to be easily adjusted. The operator can vary the amount of downforce he applies to the rear end portion of the arm, which will vary the amount of upward force applied to the post within a particular range, but many prior art post pulling devices do not have any other easy way of varying the amount of force or leverage applied to the post, or that will easily shift the range of upward force that can be operatively applied to the post. This can be disadvantageous since post pullers can be used in various soil conditions that may require different amounts of leverage for pulling a post from the ground.

Typical prior art post pullers are not easily transportable. The post pullers are topically carried by hand at various points during transport between their storage site and the job site. In other situations a line of posts must be pulled, for example from a fence-row, and an operator may wish to carry a post puller by hand between the posts to be pulled. Typical prior art post pullers are relatively awkward to carry by hand, and may even have loose parts which make transport by hand more difficult.

Many prior art post pulling devices undesirably allow an operators fingers or hands to be easily pinched between the arm and the stand as the arm pivots down close to the stand during post pulling operations.

A prior art post puller provides an extension that can be attached to the arm for effectively lengthening the arm and thereby increasing the distance between the point at which the operator presses own on the arm and the point of pivotal connection between the arm and the stand. This arm extension thereby increases the lever age applied for a given amount of downforce applied to the arm by the operator. Since these arm extensions are detachable parts they can be relatively clumsy or awkward to transport and attach and detach, and may inadvertently be lost or left behind and not brought to the job site.

Many prior art post pulling devices establish a relatively large effective lever arm or fulcrum which extends forwardly from the pivotal connection of the arm with the stand. This relatively large fulcrum created by the relatively long front portion of the arm can cause the post pulling device to be relatively unstable and subject to toppling over to the side under the large forces established during post pulling operations. Furthermore, a large fulcrum can decrease the amount of leverage or force imparted by the device for pulling the post upward.

SUMMARY OF THE INVENTION

The preferred embodiment of the present invention provides a post puller mechanism having a post pulling mode and a transport mode. The post puller includes a leg that extends upwardly from the ground surface during post pulling mode. A lever member is pivotably coupled with the leg and extends generally horizontally during the post pulling mode. The lever can be operatively grasped and pivoted by an operator during the post pulling mode for causing the post puller mechanism to pull a post from the ground. The lever can also be pivoted to a position proximate the leg during the transport mode, whereat the lever is operatively held in position proximate the leg and generally prevented from pivoting during the transport mode. During this transport mode the lever is graspable by an operator as a handle for carrying the post pulling mechanism. A base is coupled with the lower end portion of the leg, and the lever is received by an opening in the base for holding the lever in its position proximate the leg during the transport mode. The lever is extendable along a longitudinal axis of the lever and extends at least slightly to be received within the opening in the base. The lever is biased by a compression spring toward an extended position for maintaining the lever within the opening during the transport mode. Interference with a portion of the base which defines the opening blocks the lever from shifting out of the transport mode.

The lever member is pivotal with respect to the leg, and has a handle portion on one side of a pivotal connection of the lever member with the leg. A chain engaging portion is positioned on the other side of the pivotal connection. A chain is engaged with the chain engaging portion of the lever member, and in this position the chain extends downwardly and is operatively coupled via a hook and post holder to a post to be pulled from the ground. The post is pulled upwardly from the ground as the operator presses the handle portion downwardly. The chain engaging portion further comprises first and second chain engaging positions spaced from each other and whereas the chain is engagable with the chain engaging portion at different distances from the pivotal connection of the lever member with the leg. A longitudinal slot is formed in the chain engaging portion and receives a first chain link. At least one recess extends generally transverse to the longitudinal slot, said recess receives a second link of the chain directly above the first chain link when the first chain link is positioned within the longitudinal slot. The chain engaging portion abuts the second chain link for lifting the chain upwardly as the operator presses the handle portion of the lever member for pulling the post upwardly. The chain engaging portion according to the preferred embodiment includes one or more sets of laterally extending recesses spaced apart along the longitudinal slot to define first and second chain engaging positions. In one of the sets of recesses the post engaging mechanism is operatively coupled via the chain to the front end of the lever at a location less than two inches in front of the pivot axis of the lever, and more specificially, is operatively coupled with the front end of the lever at a location approximately one inch from the pivot axis of the lever. The chain includes a swivel member that allows a hook and post engaging mechanism to swivel with respect to the chain as the chain is pivoted to place other chain links in one of the sets of recesses.

The coupling mechanism is engagable with the post and is operatively connected with the post puller. The post engaging coupling mechanism includes first and second parts pivotable with respect to each other. The first and second parts define an enclosed, rigid and generally rectangular opening when the post engaging member is in a closed mode, and are pivotable from an open mode to the closed mode for enclosing and confining a post within the opening. First and second loop members are fixed with respective first and second parts. The first and second loop members are adapted to receive the hook at the lower end of the chain and when attached to the hook shift upwardly as the operator pivots the handle portion of the lever downwardly. A rounded portion of the hook presses the loop members together as the chain is pulled upwardly by the lever. The side of the generally rectangular opening closest to the first and second loop members defines a generally V-shape. The first part generally defines an L-shape and the second part generally defines a C-shape. The holder is closable around a post from the side of the post without requiring the holder to be slid along the length of the post.

A pair of plate members are fixed with the lever in close proximity and on respective sides of the leg. The plates generally block an operator's fingers from being pinched between the lever and leg as the lever is pivoted toward the leg. The plates have curved lower edge portions which help prevent an operator's fingers from being pinched between the plate members and the lever or leg.

The rear end portion of the lever is grasped and pivoted downwardly by an operator during post pulling operations. The rear end portion of the lever includes first and second portions that remain coupled with the post puller during both the post pulling mode and the transport mode. The second portion is shiftable between extended and retracted positions with respect to the first portion for effectively altering the amount of force applied to the post during post pulling operations. The first and second portions according to the preferred embodiment are first and second tube members, and the second tube member telescopes with respect to the first tube member to shift between the extended and retracted positions. The second tube is positioned within the first tube. A rod is fixed within the first tube member offset from the central axis of the first tube. An end cap positioned at an end of the second tube includes an opening within which the rod is positioned. The end cap is slidable along the rod as the second tube shifts between the retracted and extended positions. The second tube can be pivoted about its central axis to establish friction between the outer diameter of the second tube and the inner diameter of the first tube for operatively securing the second tube in a desired extended or retracted position with respect to the first tube.

DETAILED DESCRIPTION OF THE PREFERRED EMBODIMENT

Figure 1:
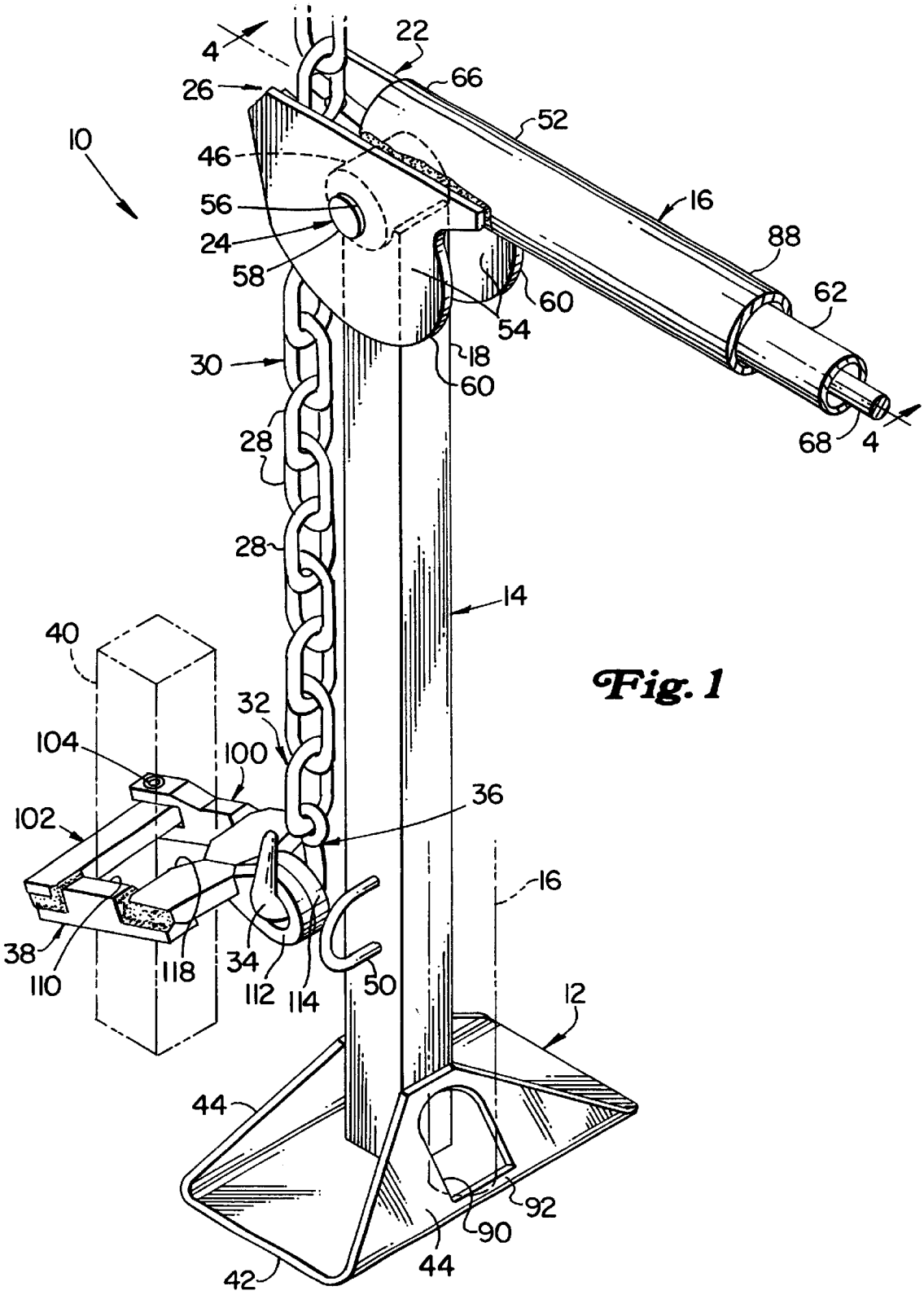
FIG. 1 is a partial perspective view of the post puller mechanism according to the present invention, showing the lever in an operative post pulling position in solid lines and the lever in a transport mode in phantom.

Referring now to FIGS. 1–10, there is shown the manual post pulling mechanism 10 according to the preferred embodiment of the present invention. As viewed in FIG. 1, the post pulling mechanism 10 includes a ground engaging base 12 and a leg 14 extending upwardly therefrom. A lever mechanism 16 is pivotally coupled to the upper end 18 of the leg 14. The rear end 20 of the lever 16 can be grasped by an operator and pressed downwardly during post pulling operations. The front end portion 22 of the lever 16 extends forwardly from the lever's pivotal connection 24 with the leg 14. The front end 22 of the lever 16 includes a slot mechanism 26 that receives the links 28 of a chain 30. The chain 30 extends downwardly from the front end 22 of the lever 16 and includes a lower end 32 having a hook 34 coupled with the end 32 of the chain 30 via a swivel connection 36. The hook 34 engages a post holder 38 that is positioned around the post 40 to be pulled during post pulling operations. As the operator presses downwardly on the rear end 20 of the lever 16 the lever 16 pivots about the pivotal connection 24 with the leg 14, causing the front end 22 of the lever 16 to swing upwardly, which in turn pulls upwardly on the chain 30 and post holder 38, thereby pulling the post 40 upwardly for removal from the ground. The structure of these various component parts will now be described in greater detail.

The base 12 includes a generally flat lower portion 42 extending generally horizontally and which engages the ground and helps stabilize the post pulling mechanism 10 during operation. The leg 14 is a rectangular tubular member welded to the base 12 and extends upwardly therefrom. Support portions 44 of the base 12 extend upwardly at angles from the lower surface 42 of the base 12 and are welded or otherwise fixed to the sides of the leg 14. The support portions 44 help support the leg 14 during post pulling operations, and help add stability and rigidity to the post pulling mechanism 10. A bushing 46 is welded to the upper end 18 of the leg 14, and includes a central opening 48 which defines the pivot axis of the lever 16. A loop 50 is welded to a side of the leg 14 and receives the hook 34 of the chain 30 during the transport mode, as will be described in greater detail below.

The lever mechanism 16 includes a first tube 52 welded or otherwise fixed with a pair of parallel spaced pivot plates 54. The pivot plates 54 each include an opening 56. A pivot pin 58 is welded in fixed position within the openings 56. The pivot pin 58 is pivotally received within the central opening 48 in the bushing 46. The pivot pin 58 and bushing 46 establish a pivot mechanism 24 that allows the lever 16 to pivot with respect to the leg 14.

The pivot plates 54 include arcuate or curved lower edges 60 that generally hinder an operators hand or fingers from being pinched between the lever 16 and the leg 14 during post pulling operations. The pivot plates 54 extend downwardly from the pivot mechanism 24 for blocking an operator from placing his hands or fingers between the lever 16 and the leg 14 in close proximity to the pivot mechanism 24 where pinching is most likely to occur. The arcuate or curved shape of the lowermost edge 60 of the pivot plates 54 also generally hinders the operator's fingers from being pinched between the leg 14 and the pivot plates 54.

Figure 4:
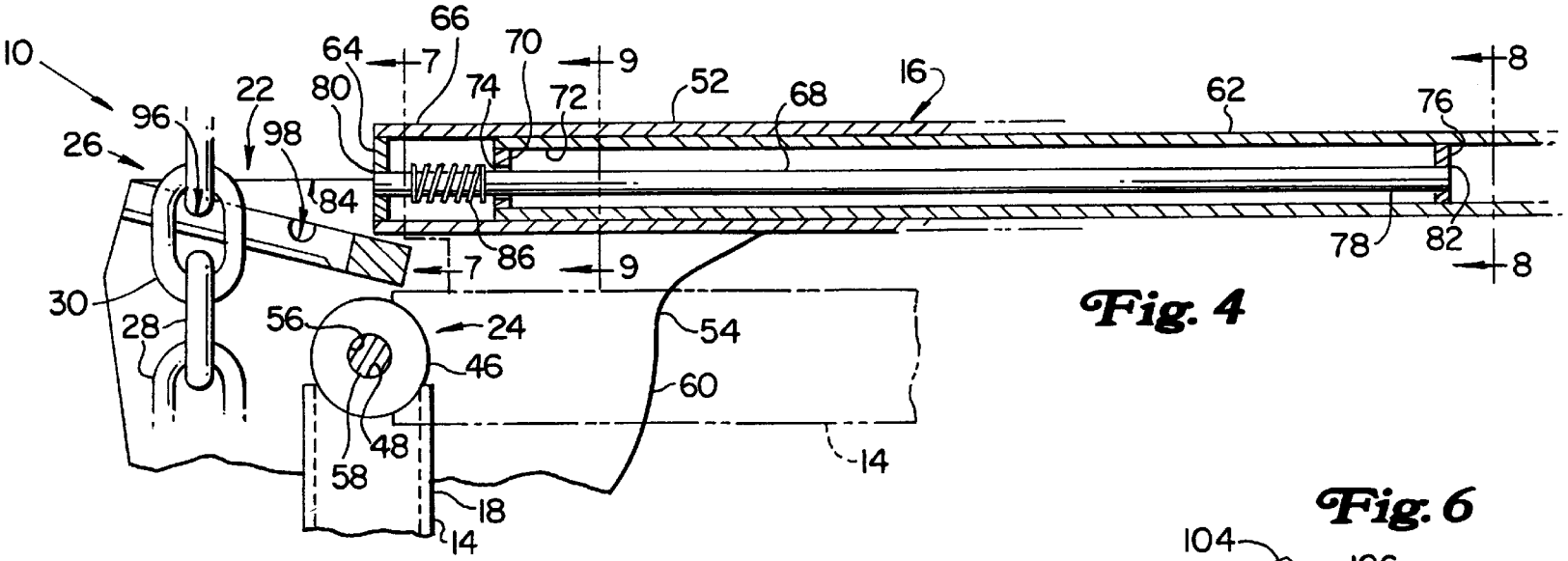
FIG. 4 is a side sectional view of the post puller mechanism according to the present invention, showing the second tube retracted within the first tube to establish a relatively short lever during post pulling operations. The chain is also shown engaged within the chain engaging portion of the front of the lever.

A second tube 62 is positioned within the first tube 52, and can be shifted rearwardly therein to effectively extend the length of the lever mechanism 16. As best seen in FIG. 4, a first end cap 64 is welded to the front end 66 of the first tube 52, and a rod 68 fixed with the first end cap 64 extends rearwardly within the first tube 52. A second end cap 70 is welded within the forward end 72 of the second tube 62, and includes an opening 74 that slidably receives the rod 68. A rod cap 76 is fixed with the rearward end 78 of the rod 68. As the second tube 62 is pulled rearwardly to effectively extend the lever 16, the rearward travel of the second tube 62 with respect to the first tube 52 is limited as the second end cap 70 abuts against the rod cap 76.

Figure 7:
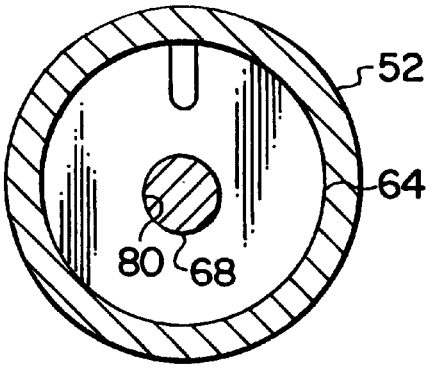
FIG. 7 is a sectional view along line 7—7 in FIG. 4, showing the first tube's first tube, first end cap and rod.
Figure 9:
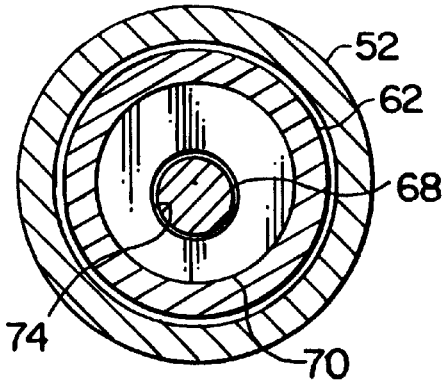
FIG. 9 is a sectional view along line 9—9 in FIG. 4, showing the first tube, second tube, second end cap and rod with the second tube in a neutral unturned position allowing the second tube to slide freely within the first tube for extending or retracting the second tube within the first tube.
Figure 8:
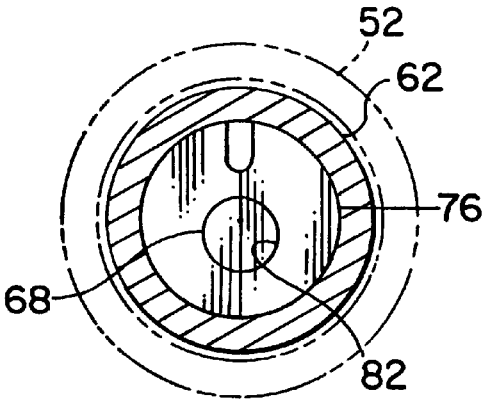
FIG. 8 is a sectional view along line 8—8 in FIG. 4, showing the first tube in phantom, and the second tube, rod end cap and rod in solid lines.
Figure 10:
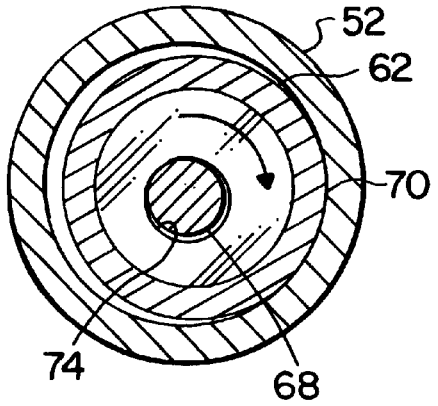
FIG. 10 is a sectional view along line 10—10 in FIG. 4, showing the first tube, second tube, second end cap and rod after an operator has pivoted turned the second tube to lock the second tube in position.

As seen in FIGS. 7, 8 and 9, the rod 68 is positioned eccentrically within the first and second tubes 52, 62. The openings in the first end cap 80, the second end cap 74 and the rod cap 82 within which the rod 68 is positioned are also positioned eccentrically or off-center within the tubes 52, 62 to accommodate the off-center position of the rod 68. The operator can rotate the second tube 62 within the first tube 52 slightly to the position shown in FIG. 10 for securing the second tube 62 in a selected extended position. The second tube 62 is generally confined within the inner diameter of the first tube 52, and therefore the second tube 62 must generally rotate about the central axis 84 of the first tube 52. However, the rod 68 and openings 74, 80 in the end caps 64, 70 are positioned offset from the central axis 84 of the first tube 52. Therefore, as the second tube 62 is turned within the first tube 52 as shown in FIG. 10, the opening 74 in the second end cap 70 begins to swing an are about the central axis 84 of the first tube 52. The edges of the opening 74 in the second end cap 70 quickly engage the edges of the rod 68, which begins to bend or flex slightly. The bending of the rod 68 forces the outer diameter of the second tube 62 into forceful engagement with the inner diameter of the first tube 52, as best seen in FIG. 10. As the second tube 62 is further twisted within the first tube 52 these surfaces engage each other with such force that sufficient friction is established for securing the first and second tubes 52, 62 together in the selected extended position. Furthermore, bending of the rod 68 in response to turning the second tube 62 within the first tube 52 shifts the rod end cap 76 to shift into engagement with the inner diameter of the second tube 62. This in turn shifts the portion of the second tube 62 in the vicinity of the rod end cap 76 to shift into forceful abutment with the inner diameter of the first tube 52. This establishes friction which serves to secure the second tube 62 in the selected position with respect to the first tube 52. Therefore, the eccentric arrangement of the rod 68 and end cap openings 74, 80 operatively causes the various parts of the lever 16 to bind together sufficiently when the second tube 62 is turned that the second tube 62 becomes locked in place within the first tube 52 due to friction between the various parts. To release this friction, the operator turns the second tube 62 in the opposite direction until the opening in the second end cap 70 is again aligned with the eccentrically positioned rod 68, as shown in FIG. 9. In this position the second tube 62 is free to shift longitudinally along the rod 68 for retracting or extending the second tube 62 within the first tube 52. Once a new position is selected for the second tube 62 it can again be turned within the first tube 52 to establish the friction required to hold the second tube 62 in the newly selected position.

Figure 3:
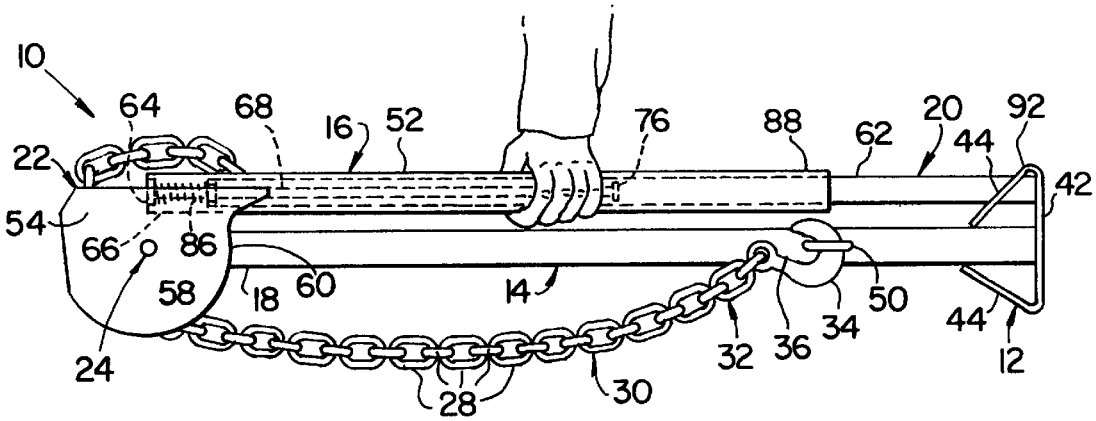
FIG. 3 is a side view of the post puller mechanism according to the present invention showing the lever in a transport mode received within the opening of the base, with the operator grasping the lever as a handle.

As seen in FIGS. 3 and 4, a compression spring 86 is coiled around the rod 68 between the first end cap 64 and the second end cap 70. When the second tube 62 is shifted forwardly into the first tube 52, the compression spring 86 is compressed between the first and second end caps 64, 70. In this configuration the compression spring 86 serves to bias the second tube 62 rearwardly toward the rearward end 88 of the first tube 52. When the post puller 10 is transported between locations the lever 16 can be pivoted downwardly to the position shown in phantom in FIG. 1 and in solid lines in FIG. 3, with the lever 16 positioned within an opening 90 in the base 12. In this position the compression spring 86 presses the second end cap 70 and second tube 62 downwardly against the lower portion 42 of the base 12. A ledge portion 92 formed in the support portion 44 of the base 12 generally prevents the lever 16 from easily shifting out of the opening 90. The compression spring 86 biases the lever 16 toward an extended position such that the lever 16 remains securely confined within the opening 90.

Figure 5:
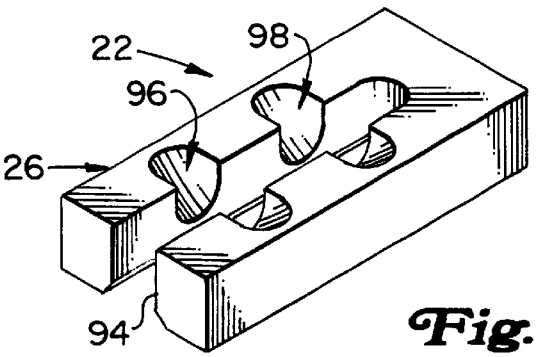
FIG. 5 is a perspective view of the chain engaging portion or chain plate showing the longitudinal slot and the front and rear sets of laterally extending recesses according to the preferred embodiment of the present invention.

As best seen in FIGS. 4 and 5, a chain plate or chain engaging portion 26 of the lever 16 is fixed as by welds between the pivot plates 54 and generally in front of the pivot pin 58. The chain plate 26 generally defines the front end portion 22 of the lever 16 located in front of the pivot mechanism 24. The chain plate 26 includes a longitudinally extending slot 94 through which a link of the chain 30 may pass when attaching the chain 30 to the lever 16. Two sets of generally laterally extending recesses 96, 98 are spaced from each other along the longitudinally extending slot 94. Once the chain 30 is shifted into the longitudinally extending slot 94, the operator can allow the chain 30 to drop down slightly until the next higher chain link is received within one of the sets of laterally extending recesses 96, 98. The link that passes through the longitudinally extending slot 94 is oriented ninety degrees from that of the link that will be received by the laterally extending recesses 96 or 98. The chain is shifted into the longitudinal slot 94 and then dropped down such that the link above the one in the longitudinal slot 94 becomes positioned within one of the sets of laterally extending recesses 96 or 98. The laterally extending recesses 96 or 98 cradle a link of the chain 30 and support the chain 30 during post pulling operations. The recesses 96 and 98 generally hold the chain 30 in proper position and help prevent the chain 30 from sliding forwardly off the end of the chain plate 26 or rearwardly toward the pivot mechanism 24.

Figure 2:
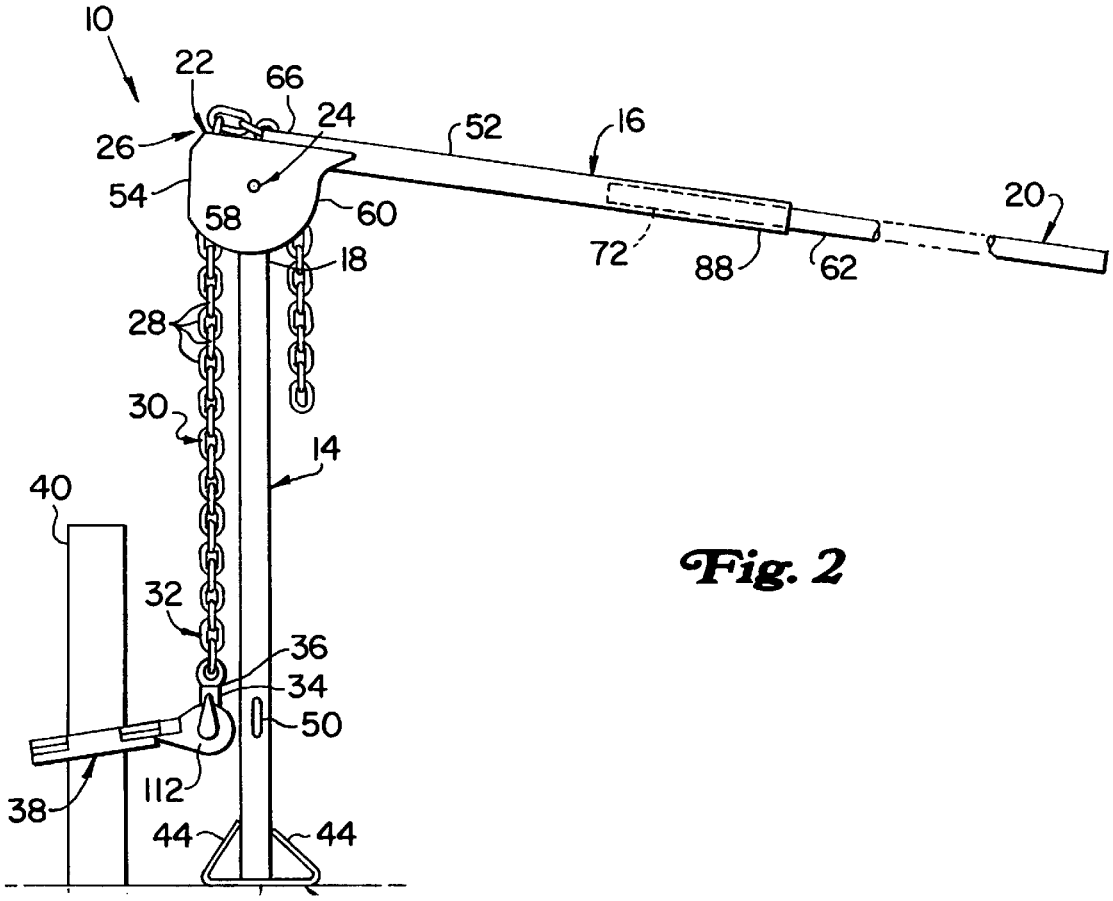
FIG. 2 is a side view of the post puller mechanism according to the present invention with the lever extended in a post pulling mode.
Figure 6:
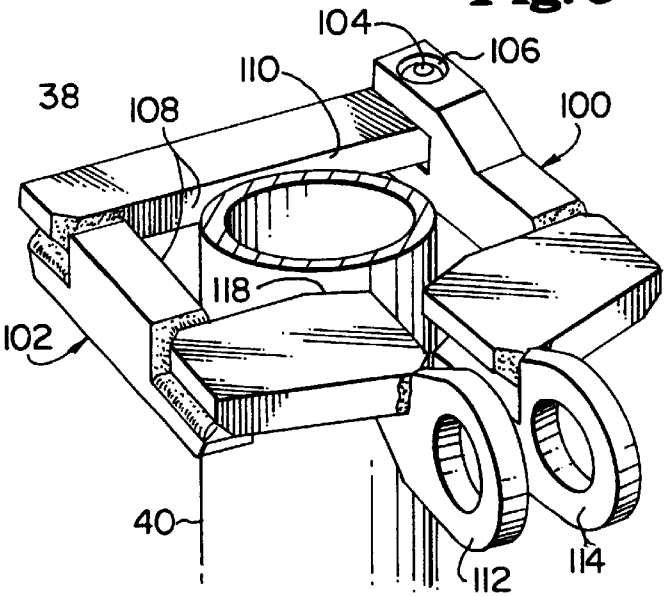
FIG. 6 is a partial perspective view of the post holder mechanism according to the present invention engaging a post to be pulled.

A hook 34, as best seen in FIGS. 1 and 2, is coupled with the lower end 32 of the chain 30. The hook 34 engages a post holder or coupling mechanism 38 that engages the post 40 during post pulling operations. The coupling mechanism 38, as best seen in FIGS. 1, 2 and 6, includes first and second parts 100, 102 that are pivotally coupled with one another. The first part 100 is generally L-shaped, and the second part 102 is generally C-shaped. A pin member 104 fixed with the first part 100 is positioned within an opening 106 in the second part 102 for establishing the hinge mechanism that allows the first and second parts 100, 102 to pivot with respect to each other. The two parts 100, 102 of the post holder 38 can be enclosed around a post 40 to be pulled. The inner edges 108 of the generally rectangular shape of the opening 110 defined by the post holder 38 will engage the outer periphery of the post 40 to be pulled.

First and second loop members 112, 114 are fixed with the respective first and second parts 100. 102 of the post holder 38. The hook 34 at the lower end 32 of the chain 30 is placed within the loop members 112, 114. As the chain 30 is pulled upwardly during post pulling operations the loop members 112, 114 are pressed together by the curved inner surface 116 of the hook 34, and are thereby pressed together tighter and tighter as the chain 30 is pulled upwardly with greater and greater force.

The side 118 of the opening 110 closest to the loop members 112. 114 defines a V-shape. This V-shape is advantageous when certain shaped posts are being pulled, such as round posts. The round outer diameter of the post is received within the V-shape, and the post tends to center itself within the opening in the holder 38 as the holder 38 and chain 30 are pulled upwardly. Similarly, the V-shape feature of the opening 110 also serves to engage other shaped posts and generally centers the post within the opening 110 of the post holder 38. Centering the post in this manner within the opening 110 in the holder 38 helps ensure that the force applied to the post by the holder 38 is directed generally straight upward without applying undesirable torque forces to the post if the post were positioned off-center.

The chain 30 includes a swivel mechanism 36 at its lower end 32. A hook 34 is pivotally attached to the chain 30 by way of the swivel mechanism 36. The swivel mechanism 36 allows the hook 34 to swivel as the chain 30 is raised or lowered one chain link. This generally hinders any torque or twist from accumulating in the chain 30, and therefore the chain 30 tends to lift relatively straight up and generally does not apply a torque to the holder 38 or post 40.

Next, the operation of the post puller 10 according to the present invention will be described in greater detail. To set up the mechanism 10 for post pulling operations the operator carries the mechanism 10 to the post 40 to be pulled. The operator can carry the mechanism 10 by grasping the lever 16 which is confined within the opening 90 in the base 12 during a transport mode, as seen in FIG. 3. The operator sets the base 12 of the mechanism 10 on the ground adjacent the post 40 and presses the second tube 62 upwardly further into the first tube 52 against the biasing force of the compression spring 86. With the second tube 62 shifted upwardly there is sufficient clearance for the lower end of the second tube 62 to pass over the ledge 92 and out of the opening 90. The operator can then swing the lever 16 upwardly about its pivotal connection 24 with the leg 14 to the position shown in FIGS. 1 and 2.

The operator can then place the holder 38 in position around the post 40. The first and second parts 100, 102 of the holder 38 are first pivoted to an open position. The operator then places the post 40 within the open jaws of the holder 38, and closes the two parts 100, 102 of the holder 38 around the post 40. The holder 38 thereby establishes a generally rectangular opening 110 within which the post 40 is confined.

The operator then couples the holder 38 with the lever 16 by placing the hook 34 within the loop members 112, 114 and, while pulling up on the chain 30, shifts a link of the chain 30 into the longitudinal slot 94 formed in the front end portion 22 of the lever 16. Once the chain 30 is slid into the longitudinal slot 94 the chain 30 can be lowered down slightly until the next higher chain link becomes positioned within one of the sets of laterally extending recesses 96 or 98. The chain 30 is thereby generally held in place with respect to the lever 16. The operator can then grasp the rear portion 20 of the lever 16 and apply a downward force, which pivots the rear portion 20 of the lever 16 downwardly and the front portion 22 of the lever 16 upwardly. Upward shifting of the front portion 22 of the lever 16 causes the chain 30 to be pulled upwardly, pulling upwardly on the hook 34, loop members 112, 114 and holder mechanism 38. This causes the post 40 to also be pulled upwardly.

If the operator presses down on the rear end portion 20 of the lever 16 and the resulting force applied to the post 40 is not sufficient to dislodge the post 40, then the operator can pull the second tube 62 outwardly with respect to the first tube 52, thereby effectively lengthening the rear portion 20 of the lever 16. With the second tube 62 extended in this manner, the operator can press downwardly on the second tube 62 at a greater distance to the rear of the pivot mechanism 24. This establishes a larger moment arm which results in greater leverage for effectively increasing the amount of upward force applied to the post 40. Therefore, by extending the second tube 62 and pressing downwardly on the extended second tube 62 the operator can increase the amount of force applied to the post 40 for dislodging the post 40 from the ground.

The operator can also easily vary the amount of force applied to the post 40 by shifting the chain 30 between the two sets of laterally extending recesses 96, 98. If the operator places the chain 30 within the laterally extending recesses 96 furthest from the pivot mechanism 24, as is shown in FIG. 4, then the amount of force applied to the post 40 will be less than if the chain 30 is positioned within the laterally extending recesses 98 closest to the pivot mechanism 24. By placing the chain in recess 96, the pulling are is increased allowing the post to be pulled faster with fewer strokes of lever 16.

During installation of the chain 30 and holder 38 to the post 40 to be pulled, the operator will place the holder 38 around the post 40, close the holder 38, and then place the hook 34 in the loops 112, 114. The operator will then pull the chain 30 upwardly and shift a chain link into the longitudinal slot 94. As he does this he may spin the chain 30 so that a particular link is aligned with the longitudinal slot 94. The swivel mechanism 36 to which the hook 34 is coupled allows the chain 30 to swivel in this manner without placing undesirable torque in the chain 30. Such torque would escalate as the operator applies downforce to the lever 16 during post pulling operations. This torque would apply a force to the post 40 in a direction other than straight up, and therefore may hinder the post 40 from being easily pulled upwardly. The swivel mechanism 36 generally eliminates this undesirable torque.

Once the post 40 is pulled from the ground the operator may wish to transport the post pulling mechanism 10 to another site, such as to another post to be pulled or to a site where the mechanism 10 can be stored. The operator can remove the hook 34 from the loop members 112, 114 and open the holder 38 so that it can be easily removed from the post 40. Because the holder 38 opens it can be easily removed from the post 40 without requiring an operator to slide the holder 38 all the way off the end of the post 40. The opened holder 38 is easily removed from the post 40. The operator then pivots the rear portion 20 of the lever 16 until it is generally adjacent the leg 14. The second tube 62 is then shifted upwardly into the first tube 52 against the biasing force of the compression spring 86. This allows clearance for the second tube 62 to pass over the ledge 92 at the lower edge of the opening 90 in the base 12. With the second tube 62 pressed upwardly, the operator continues to pivot the rear portion 20 of the lever 16 toward the leg 14 until it is aligned with the opening 90. At this time the operator can release the second tube 62, and the compression spring 86 presses the second tube 62 downwardly into the opening 90. The compression spring 86 generally biases the second tube 62 into the opening 90, and in this semi-extended position the edges of the opening 90 generally confine the second tube 62 for maintaining the lever 16 in this position. The lever 16 is thereby prevented from pivoting upwardly away from the leg 14. When the lever 16 is received within the opening 90 in this manner the lever 16 can serve as a handle that an operator can grasp for carrying the mechanism 10 between locations. In this configuration the lever 16 and leg 14 remain fixed together as a unit, allowing an operator to grasp the lever 16 as a handle and lift the entire post puller 10 as a unit. The lever 16 is not allowed to pivot with respect to the leg 14, and therefore the post puller mechanism 10 remains a compact unitary structure during transport that does not swing open when carried in this configuration. The post puller 10 according to the preferred embodiment becomes a relatively compact structure that can easily be transported between locations by hand. With the lever 16 in this position and the chain 30 engaged within the one of the sets of laterally extending recesses 96 or 98 the operator can place the hook 34 in the hook loop 50. When the operator lifts the mechanism 10 by grasping the lever 16 as a handle as shown in FIG. 3 the hook 34 will remain within the hook loop 50 and the upper end of the chain 30 will remain engaged within the longitudinal slot 94 and laterally extending recesses 96 or 98. This supports the chain 30 during transport and generally prevents the length of the chain 30 from falling downwardly. In this configuration the leg 14, base 12, lever 16 and chain 30 therefore comprise a relatively compact structure that is easily transported by hand to the next post to be pulled or back to a storage area. Furthermore, the lever 16 becomes locked in position with respect to the leg 14 without requiring tools or loose parts that might be misplaced.

The post puller 10 according to the preferred embodiment provides the advantage of allowing easy adjustment of the amount of leverage applied to the post 40. The operator can apply a downwardly directed force to the lever 16 with the second tube 62 retracted within the first tube 52. This establishes a comparatively short effective moment arm for lifting the post 40 out of the ground. The operator also may extend the second tube 62 rearwardly with respect to the first tube 52 which effectively lengthens the lever 16. The operator can then apply the downforce to the lever 16 at a greater distance from the pivot mechanism 24, which increases the effective moment arm and increases the upward force established for pulling the post 40 out of the ground. Therefore the operator has many positions at which to set the second tube 62 which will result in different forces applied to the post 40. The operator can adjust the position of the second tube 62 with respect to the first tube 52 without tools or loose parts that might be misplaced. The operator can twist the second tube 62 within the first tube 52 to lock the second tube 62 in the selected extended position as described above. It is therefore a relatively simple operation to fix the second tube 62 in a selected position.

The present post puller 10 also provides a second way in which the force applied to the post 40 can be easily adjusted by the operator. The operator can pull posts as described above with the chain 30 received within the set of laterally extending recesses 96 furthest from the pivot mechanism 24, which will impart an upwardly directed force to the post 40. To vary the amount of upforce applied to the post 40 the operator can reposition the link in the laterally extending recesses 98 closest to the pivot mechanism 24. This set of recesses 98 establishes a larger amount of leverage and upforce because this set of recesses 98 is positioned closer to the pivot mechanism 24 than the other set of recesses 96. The operator can thereby vary the amount of force applied by simply shifting the chain 30 to the other set of recesses 96, 98 in the front end 22 of the lever 16. This is accomplished relatively easily, without requiring the use of tools or loose parts that might be misplaced. The longitudinally extending slot 94 and the laterally extending sets of recesses 96, 98 provide structure that allows the operator to easily attach the chain 30 to the front portion 22 of the lever 16 and also allows the operator to relatively easily shift the position of the chain 30 to vary the upforce transmitted to the post 40.

The design of the post holder mechanism 38 has several advantages over the prior art. The first and second parts 100, 102 of the holder 38 pivot with respect to each other to allow the holder 38 to hinge to an open configuration for allowing the holder 38 to be easily coupled with a post 40 to be pulled. In an open configuration the holder 38 is positioned next to the post 40 to be pulled and then closed around the post 40. The holder 38 can be closed around the side of the post 40 without requiring the holder 38 to be slipped over the top end of the post 40. When closed the holder 38 extends all the way around the post 40 to completely confine the post 40. This prevents the post 40 from slipping out of the holder 38 during post pulling operations. And the enclosed nature of the holder 38 makes the holder structure more rigid than if one of the sides 108 of the holder 38 were open. Therefore the holder 38 according to the present invention is relatively strong and resistant to bending when large forces are encountered by the holder 38 during post pulling operations.

Once the holder 38 is closed around the post 40 the hook 34 is inserted into the loops 112, 114, which acts to hold the two parts 100, 102 in the closed configuration. The curvature of the hook 34 tends to press the two loop members 112, 114 tighter together as the chain 30 is pulled upwardly with greater and greater force during post pulling operation. This helps ensure that the two parts 100, 102 of the holder 38 remain in the closed configuration during operation. The loop members 112, 114 are pressed together but do not cause the sides 108 of the opening 110 to shift closer together. The holder 38 according to the present invention allows the edges 108 of the opening 110 to retain a predetermined shape such that the edges 108 do not shift toward each other and bite into the sides of the post 40, which might damage the post 40 or make the holder 38 difficult to remove after completion of post pulling operations.

The edge or side 118 of the rectangular opening 110 closest to the loop members 112, 114 defines a V-shape. As the chain 30 is lifted and the loop members 112, 114 shift upwardly therewith, the holder 38 engages the post 40, and the post 40 tends to become centered within the opening 110 as the post 40 engages the V-shaped edge 118. This helps ensure that the holder 38 will pull generally straight up on the post 40. If the post 40 shifts to one side within the opening 110 the holder 38 might tend to apply torque forces to the post 40, which can hinder the post 40 from being pulled.

The post puller mechanism 10 according to the preferred embodiment allows the chain 30 to be coupled to the front end portion 22 of the lever 16 at a location less than two inches, and more specifically approximately one inch, from the pivotal connection 24 of the lever 16 to the leg 14. This relatively small fulcrum has several advantages. The close proximity to the pivot axis 24 of the lever 16 establishes a relatively large amount of leverage or force applied to the post 40 such that the post 40 is more easily pulled upwardly from the ground for a given amount of force applied to the lever 16 by the operator. The close proximity also enhances stability of the post pulling mechanism 10 during post pulling operations. The farther out in front of the pivotal connection 24 the chain 30 engages the front end 22 of the lever 16, the more susceptible the mechanism 10 is to tipping or leaning to one side as the large forces are applied during post pulling operations.

These and other advantages of the post puller mechanism 10 according to the present invention will be apparent to a person having ordinary skill in the art.

What is claimed is:

1. A post puller mechanism having a post pulling mode and a transport mode, comprising:

a) at least one leg extending upwardly from a ground surface during post pulling mode;

b) a lever pivotably coupled with said leg and extending generally horizontally during the post pulling mode, the lever being grasped and pivoted by an operator during a post pulling mode, said lever being pivoted from horizontal to a position proximate the leg during the transport mode, the lever being held in position proximate the leg and generally prevented from pivoting during the transport mode;

c) the lever during transport mode being grasped at a balance point by an operator as a handle for carrying the post pulling mechanism during the transport mode;

d) a base coupled with the leg;

e) said lever being received by the base for holding the lever in its position proximate the leg during the transport mode; and f) the base includes an opening within which the lever is received in the transport mode for holding the lever in position during the transport mode.

2. The mechanism of claim 1, wherein the lever is extendable along a longitudinal axis of the lever and extends at least slightly to be received within the opening in the base.

3. The mechanism of claim 2, wherein the lever is biased toward an extended position for maintaining the lever within the opening during the transport mode.

4. The mechanism of claim 3, wherein interference with a portion of the base which defines the opening blocks the lever from shifting out of the transport mode.

5. The mechanism of claim 4, wherein the base is coupled with a lower end of the leg for engagement with the ground during the post pulling mode.

6. The mechanism of claim 3, wherein the base is coupled with a lower end of the leg for engagement with the ground during the post pulling mode.

7. The mechanism of claim 2, wherein the base is coupled with a lower end of the leg for engagement with the ground during the post pulling mode.

8. The mechanism of claim 1, wherein the base is coupled with a lower end of the leg for engagement with the ground during the post pulling mode.

* * * * *